US009763521B2

(12) United States Patent
Krishtul

(10) Patent No.: US 9,763,521 B2
(45) Date of Patent: Sep. 19, 2017

(54) TOROIDAL SEATING CUSHION

(71) Applicant: Max Krishtul, Brooklyn, NY (US)

(72) Inventor: Max Krishtul, Brooklyn, NY (US)

( * ) Notice: Subject to any disclaimer, the term of this patent is extended or adjusted under 35 U.S.C. 154(b) by 0 days.

(21) Appl. No.: 14/808,321

(22) Filed: Jul. 24, 2015

(65) Prior Publication Data

US 2017/0000263 A1 Jan. 5, 2017

Related U.S. Application Data

(63) Continuation-in-part of application No. 29/532,201, filed on Jul. 2, 2015.

(51) Int. Cl.
*A47C 7/18* (2006.01)
*A47C 7/02* (2006.01)

(52) U.S. Cl.
CPC ..... *A47C 7/022* (2013.01); *A47C 7/021* (2013.01); *A47C 7/18* (2013.01)

(58) Field of Classification Search
CPC ..... A47C 7/022; A47C 7/021; A47C 7/18
USPC ..... 297/452.21, 452.22, 452.23, 452.24, 297/452.25, 452.26, 452.27, 452.28; 5/648
See application file for complete search history.

(56) References Cited

U.S. PATENT DOCUMENTS 3,205,010 A * 9/1965 Schick ..... A47C 7/021 297/452.21 X
3,376,070 A * 4/1968 Johnson ..... A47C 7/022 297/452.25 X
3,503,649 A * 3/1970 Johnson ..... A47C 7/022 297/452.25
3,890,004 A * 6/1975 Rail ..... A47C 3/16 297/452.21 X
5,079,785 A 1/1992 Garcia
5,522,106 A * 6/1996 Harrison ..... A47C 7/022 297/452.25
5,613,256 A * 3/1997 Hanson ..... A61G 5/1043 297/452.26 X
7,083,229 B2 * 8/2006 Cope ..... B62J 1/00 297/452.24 X
7,216,388 B2 * 5/2007 Bieganek ..... A47C 7/022 297/452.26
7,373,678 B2 * 5/2008 Hetzel ..... A47C 7/022 297/452.26 X
7,444,698 B2 11/2008 Jackson
(Continued)

OTHER PUBLICATIONS

Contour Health, The Kabooti Comfort Ring, retrieved on Jun. 11, 2015, Catalog, retrieved from Internet Web Archives Jan. 31, 2013,http://web.archive.org/web/20130131115546/http://www.contourhealth.com/?page_id=126, Charlotte, NC, USA.

*Primary Examiner* — Rodney B White
(74) *Attorney, Agent, or Firm* — IDP Patent Services; Olav M. Underdal

(57) ABSTRACT

A toroidal seat cushion, in the shape of a ring-torus, can include a central aperture, a right leg support cutout, a left leg support cutout, and a rear cutout, which can allow a person sitting in the cushion to experience reduced pressure on the person's coccyx and central buttocks, while having support and guidance to the position of the legs. The features of the cushion may promote a healthy sitting posture, proper spine alignment, and may reduce or prevent pain in the lower back and central buttocks. Also disclosed is a method for configuring a support contour of a cushion.

16 Claims, 5 Drawing Sheets

(56) References Cited

U.S. PATENT DOCUMENTS

D681,995 S 5/2013 Davis et al.
9,021,637 B1 * 5/2015 Whelan ..... A61G 5/1043 297/452.25
9,125,493 B2 * 9/2015 Siekman ..... A47C 7/021
9,220,345 B2 * 12/2015 Davis ..... A47C 7/62
9,332,850 B2 5/2016 Krishtul
2002/0175553 A1 * 11/2002 Steifensand ..... A47C 3/00 297/452.22
2003/0121103 A1 * 7/2003 Wempe ..... A47C 7/022 5/654
2005/0066445 A1 * 3/2005 Christofferson ..... A47C 7/021 5/654
2005/0200187 A1 * 9/2005 Vela-Cobos ..... A47C 7/022 297/452.22
2007/0057562 A1 * 3/2007 Gregory ..... A47C 7/022 297/452.21
2007/0096523 A1 * 5/2007 Greene, Jr. ..... A47C 7/024 297/452.26 X
2010/0187888 A1 * 7/2010 Gallegos ..... A47C 7/022 297/452.21 X
2012/0068507 A1 * 3/2012 Debevec ..... A47C 7/021 297/250.1
2012/0119560 A1 * 5/2012 Wu ..... A47C 7/022 297/452.21
2013/0193738 A1 * 8/2013 Siekman ..... A47C 7/021 297/452.56
2013/0198961 A1 * 8/2013 Davis ..... A47C 7/62 5/648
2013/0257132 A1 * 10/2013 Chen ..... A47C 7/021 297/452.21
2013/0285432 A1 * 10/2013 Adams ..... A47C 7/022 297/452.21 X
2016/0166063 A1 * 6/2016 Siekman ..... A47C 7/021 297/452.26
2017/0099953 A1 * 4/2017 Harte ..... A47C 7/744
2017/0136294 A1 * 5/2017 Piksa ..... A63B 23/02

* cited by examiner

Toroidal Seat Cushion

TOROIDAL SEATING CUSHION

CROSS-REFERENCE TO RELATED APPLICATIONS

This application is a continuation-in-part of U.S. Design application Ser. No. 29/532,201 filed Jul. 2, 2015.

FIELD OF THE INVENTION

The present invention relates generally to the field of seat cushions, and more specifically to seat cushions that allows persons having discomfort of the central part of the buttocks and coccyx areas of the body to sit more comfortably.

BACKGROUND OF THE INVENTION

A seat cushion aims to provide a comfortable seating experience. Seat cushions can either be designed for permanent position in a chair or be designed for portable use in different seating situation, such as for example in different chairs, car seats, and wheelchairs.

Contoured cushions are well known, and there are several well-known variants of cushions designed for reducing pressure to the tailbone, in addition to assisting in the relief of pain and pressure due to hemorrhoids, rectal surgery and episiotomy. However existing cushion designs generally do not provide adequate support for the legs, and when designed with features to reduce pressure to these areas, they almost always include a significant slant, which while promoting reducing pressure in the rear part of the cushion, also can result in a more unstable seating position.

Generally, these past cushion designs may achieve a goal of reducing pressure on either the coccyx or the central buttocks, but may not provide relief for both areas, and due to their inadequate support and unstable seating position, may not promote or ensure an overall healthy seating posture, proper spine alignment and pressure discomfort.

As such, considering the foregoing, it may be appreciated that there continues to be a need for novel and improved devices and methods for contoured cushions designed for reducing pressure on the coccyx and central part of the buttocks.

SUMMARY OF THE INVENTION

The foregoing needs are met, to a great extent, by the present invention, wherein in aspects of this invention, enhancements are provided to the existing model of seat cushions.

In an aspect, the toroidal seat cushion can include a central aperture, which can be in the shape of an elongated ellipsoid which allows the seat cushion to relieve pressure and improve stabilization and support to the coccyx and central part of the buttocks.

In a related aspect, a toroidal seat cushion can further include a right leg support cutout, and a left leg support cutout, where both leg support cutouts run parallel to the sides, substantially in the middle between the sides and the centerline of the cushion. The leg support cutouts serve to support, guide, and position the legs of a person seated in the cushion.

In a related aspect, the toroidal seat cushion can further include a rear cutout, which serves to reduce any pressure on the coccyx or central buttock area of a person seated in the cushion.

In related aspects, the leg support cutouts can have various degrees of negative or positive slant, or a slant of substantially zero.

In a related aspect, the toroidal seat cushion can be manufactured with an inner core of high-resilience upholstery foam.

In a related aspect, the seat cushion can further include a cushion cover.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
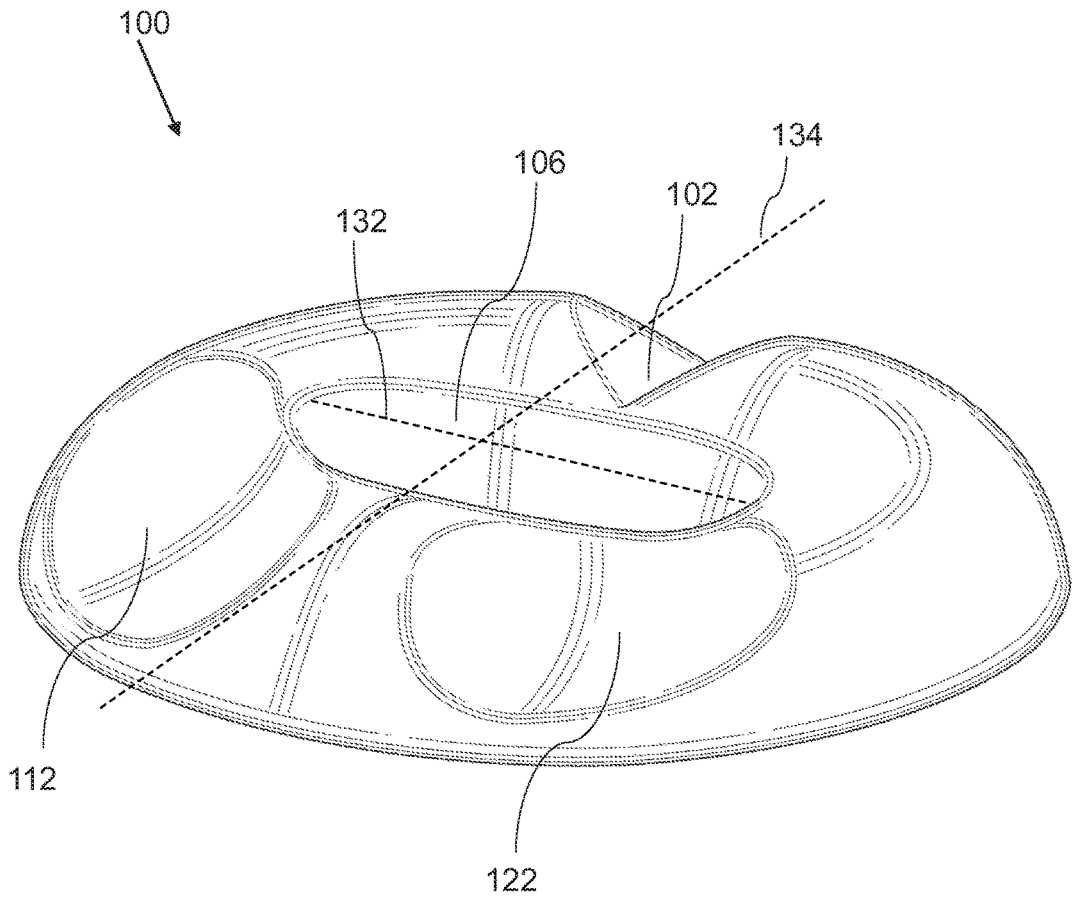
FIG. 1 is a top perspective view of a toroidal seat cushion, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of the toroidal seat cushion with reference to FIG. 1, in such manner that like reference numerals refer to like components throughout; a convention that we shall employ for the remainder of this specification.

In an embodiment, as shown in FIG. 1, a toroidal seat cushion 100, which is ring-torus shaped, can comprise:

a. a central aperture 106, which can be in the shape of an elongated ellipsoid, such that an elongated center axis 132 of the central aperture 106 is perpendicular to a front to rear centerline 134 of the toroidal seat cushion, whereby a person when seated in a standard position can reduce pressure on the person's central buttocks area;

b. A rear cutout 102, which is positioned on an upper rear part of the toroidal seat cushion 100, such that it is configured with a shape, which is left-right reflection symmetrical with respect to the front to rear centerline 134, whereby a person when seated in a standard position can reduce pressure on the person's coccyx;

c. A right leg support cutout 112, which is positioned on an upper front right part of the toroidal seat cushion 100, such that the right leg support cutout 112 is configured to support, guide, and position a right leg of a person seated on the toroidal seat cushion 100 in a conventional position;

d. A left leg support cutout 122, which is positioned on an upper front left part of the toroidal seat cushion 100, such that the left leg support cutout 122 is configured with a shape, which is symmetrical with a shape of the right leg support cutout 112, with respect to the front to rear centerline 134, such that the left leg support cutout 122 is configured to support, guide, and position a left leg of a person seated on the toroidal seat cushion 100 in a conventional seating position;

whereby the seat cushion 100 stabilizes a seating position of a user, thereby providing relief from pressure and pain to the tail bone, lower back and central buttocks.

Figure 2:
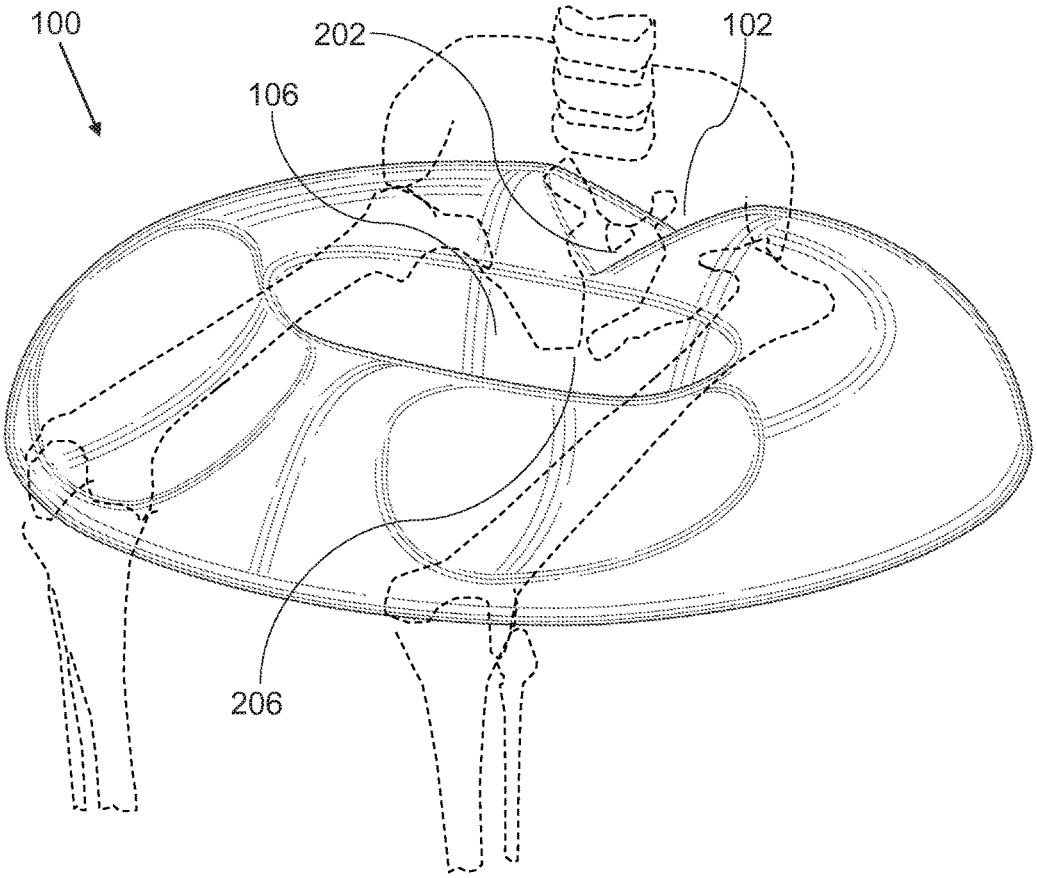
FIG. 2 is a top perspective view of a toroidal seat cushion, illustrating by superimposition the approximate seating position and support of a person's skeletal structure, according to an embodiment of the invention.

In an embodiment, FIG. 2 shows the same view as FIG. 1, and illustrates by superimposition the approximate seating position and support of a person's skeletal structure, shown in dotted lines, when seated in a conventional seating position, illustrating how the central aperture 106 alleviates pressure to the central buttocks area 206 of the user and the rear cutout 102 alleviates pressure to the coccyx area 202 of the user.

Figure 3:
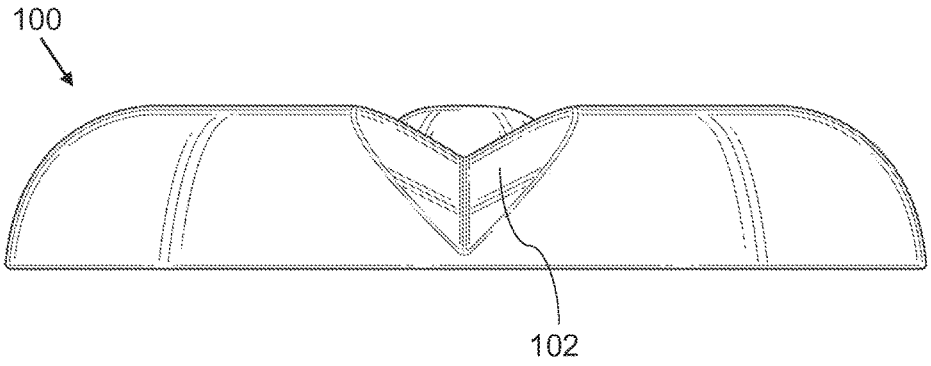
FIG. 3 is a top view of a toroidal seat cushion, according to an embodiment of the invention.
Figure 4:
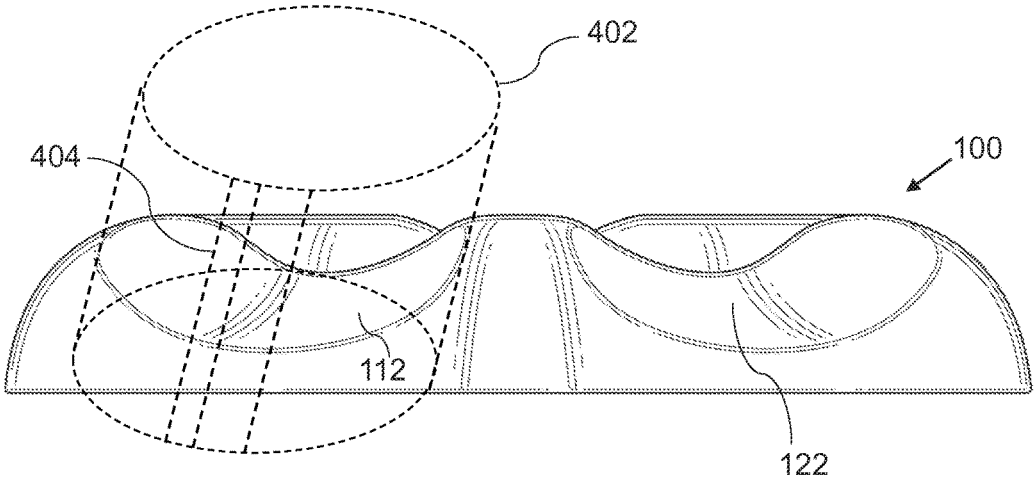
FIG. 4 is a rear view of a toroidal seat cushion, according to an embodiment of the invention.

In an embodiment, FIGS. 3 and 4, show respectively a rear and front view of the toroidal seat cushion 100.

In an embodiment, surfaces of the right and left leg support cutouts 112 122 can be concave.

In an embodiment, surfaces of the right and left leg support cutouts 112 122 can be shaped as an inner segment of a sphere, which is concave.

In an embodiment, surfaces of the right and left leg support cutouts 112 122 can be shaped as an inner segment of an ellipsoid, which is concave.

In an embodiment, cutout surfaces of the right and left leg support cutouts 112 122 can be shaped as an inner segment of a circular cylinder, whereby surface lines following the elongated direction of the cylinder are straight and all other surface lines are concave.

In an embodiment, such as shown in FIG. 4, surfaces of the right and left leg support cutouts 112 122 can each be shaped as an inner segment of an elliptic cylinder 402, such that surface lines 404, following the elongated direction of the elliptic cylinder 402 are straight and all other surface lines are concave, such that the straight surface lines can have an outward angle and a downward inclination angle.

In a related embodiment, surfaces of the right and left leg support cutouts 112 122 can each be shaped as an inner segment of a general cylinder, which includes elliptic, circular, parabolic, and hyperbolic cylinders, and cylinders of other shapes, such that surface lines 404, following the elongated direction of the general cylinder 402 are straight and all other surface lines are concave, such that the straight surface lines can have an outward angle and a downward inclination angle.

Figure 5:
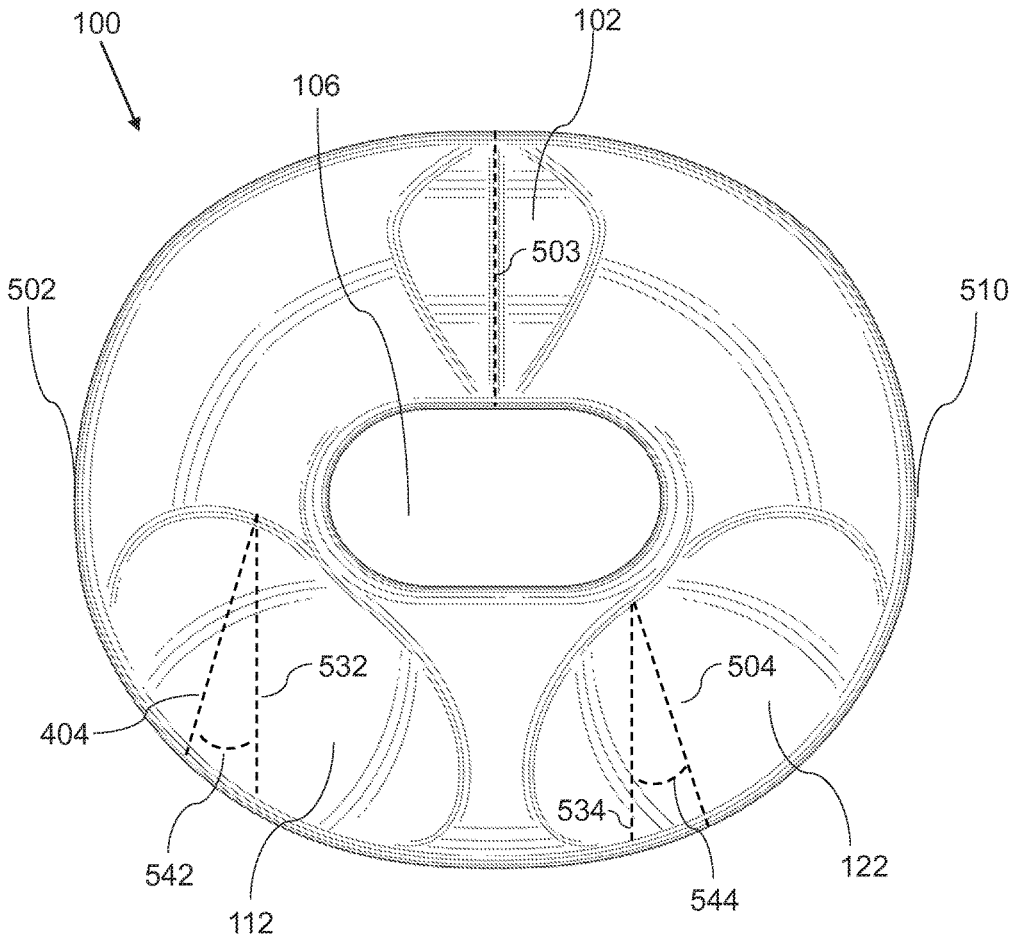
FIG. 5 is a front view of a toroidal seat cushion, according to an embodiment of the invention.

In a further related embodiment, FIG. 5 illustrates the outward angle of surface lines, as respectively:

a. a right outward angle 542 of a straight surface line 404 of the right cutout 112, relative to the centerline 134, or as here shown, a line 532 parallel to the centerline 134; and b. a left outward angle 544 of a straight surface line 504 of the right cutout 112, relative to the centerline 134, or as here shown, a line 534 parallel to the centerline 134.

In a related embodiment, the right and left outward angles 542 544 can each be configured in a range of 1 to 45 degrees.

In an embodiment, FIG. 5, shows a top view of the toroidal seat cushion 100, further illustrating by superimposed dotted lines:

a. The right side of the cushion 502;

b. The left side of the cushion 510;

c. The rear cutout centerline 503, which is a lowest point line of the rear cutout 102.

Figure 6:
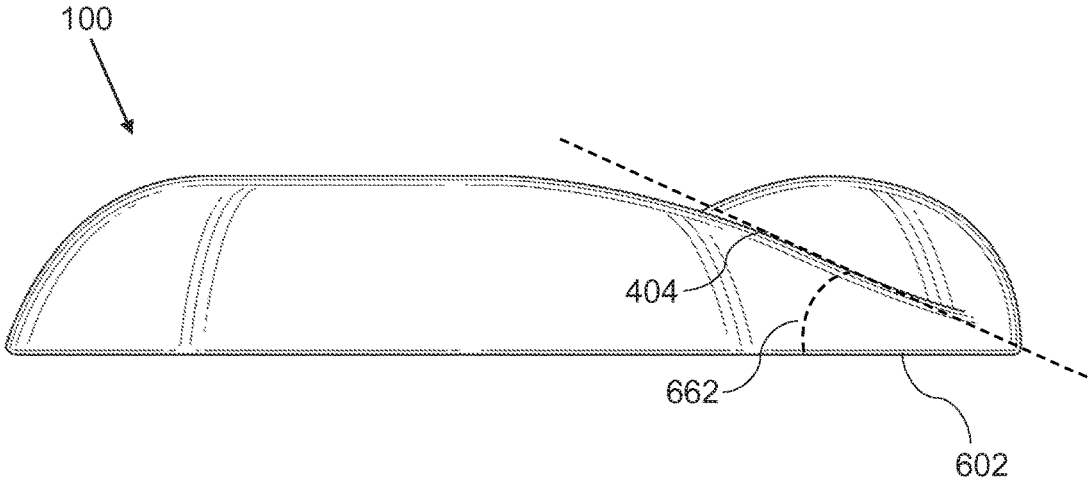
FIG. 6 is a side view of a toroidal seat cushion, according to an embodiment of the invention.

In a further related embodiment, FIG. 6 illustrates the right or left downward inclination angle 662 of respectively a right or left surface line 404, relative to a horizontal plane of an underside 602 of the toroidal seat cushion 100

In a related embodiment, the right and left downward inclination angles 662 can each be in a range of 1 to 45 degrees.

In an embodiment, the toroidal seat cushion 100 can be manufactured with an inner core made of a high-resilience upholstery foam, such as for example an open or closed cell flexible polyurethane foam with a density in a range from 20 to 60 kg/m3, whereby the upholstery foam can provide softness to underlying hard surfaces so that sitting can become more comfortable.

In a related embodiment, the upholstery foam can be sufficiently high-resilience and of sufficient density to not flatten out during use, and always regain its shape after use.

In further related embodiments, the toroidal seat cushion 100 can be manufactured with an inner core made of other suitable cushioning or upholstery materials, such as gel, memory foam, viscoelastic polyurethane foam, etc.

In a further embodiment, the inner core of the toroidal seat cushion 100, can be covered with a cushion cover, which can be made of common cushion cover materials, such as different fabrics, including velour, natural leather, suede, microfiber fabrics, synthetic leather or suede, etc.

In a further related embodiment, the cushion cover can be removable, via well-known methods, such as for example a zip on the front underside of the cover.

In related embodiments, the toroidal seat cushion 100 can:

a. add comfort to a chair, bench, car seat, plane seat, floor, wheelchair, or other seating surface;

b. reduce, alleviate, prevent or eliminate back pain by reducing body weight pressure on the coccyx and central buttocks, via the central aperture 106 and the rear cutout 102;

c. Promote a healthy sitting posture, proper spine alignment, superior comfort; and d. Reduce, alleviate, prevent or eliminate pressure ulcers A method of configuring a support contour or shape of a cushion to promote a healthy sitting posture, can comprise:

a. Configuring a cushion with a ring-torus shape and a central aperture, such that a user's weight is supported by the upper cushion surface whereas the center is substantially weightless when a person is seated in the cushion, thus reducing pain and pressure to the lower back and central buttocks;

b. Defining leg support areas, which can be contoured cutouts to position, guide and support the legs;

c. Making a cutout in the rear area of the cushion, which can ensure that there is reduced pressure on the lower back and central buttocks of a person seated in the cushion;

The many features and advantages of the invention are apparent from the detailed specification, and thus, it is intended by the appended claims to cover all such features and advantages of the invention, which fall within the true spirit and scope of the invention.

Consequently, the various embodiments of the invention described herein are multifold and can be manifested in a large plurality of different cushion designs and shapes.

Many such alternative configurations and shapes are readily apparent, and should be considered to be fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A toroidal seat cushion, which is ring-torus shaped, comprising:

a. a central aperture, which penetrates entirely through a central part of the toroidal seat cushion;

b. a right leg support cutout, which is positioned on an upper front right part of the toroidal seat cushion, such that the right leg support cutout is configured to support, guide, and position a right leg of a user that is seated on the toroidal seat cushion;

c. a left leg support cutout, which is positioned on an upper front left part of the toroidal seat cushion, such that the left leg support cutout is configured with a shape, which is symmetrical with a shape of the right leg support cutout, with respect to a front to rear centerline of the toroidal seat cushion, such that the left leg support is configured to support, guide, and position a left leg of the user that is seated on the toroidal seat cushion;

wherein surfaces of the right and left leg support cutouts are concave; and wherein surfaces of the right and left leg support cutouts are each configured with a shape as an inner segment of an ellipsoid, whereby surface lines following an elongated direction of the elliptic cylinder are straight surface lines;

whereby the toroidal seat cushion is configured to stabilize a seating position of the user, thereby providing relief from pressure and pain to a lower back and central buttocks of the user.

2. The toroidal seat cushion of claim 1, wherein the central aperture is configured in the shape of an elongated ellipsoid, such that an elongated center axis of the central aperture is perpendicular to a front to rear centerline of the toroidal seat cushion.

3. The toroidal seat cushion of claim 1, further comprising a rear-cutout, whereby the user experiences reduced pressure on a coccyx and central buttocks of the user, when seated in the cushion.

4. The toroidal seat cushion of claim 1, wherein the surfaces of the right and left leg support cutouts are each configured with a shape as an inner segment of a circular cylinder.

5. The toroidal seat cushion of claim 1, wherein the straight surface lines comprise right and left straight surface lines of respectively the right and left cutouts;

such that the right straight surface lines are configured with a right outward angle in a range of 1 to 45 degrees, relative to the centerline of the toroidal seat cushion; and such that the left straight surface lines are configured with a left outward angle in a range of 1 to 45 degrees, relative to the centerline of the toroidal seat cushion.

6. The toroidal seat cushion of claim 1, wherein the straight surface lines comprise right and left straight surface lines of respectively the right and left cutouts;

such that the right straight surface lines are configured with a right downward inclination angle in a range of 1 to 45 degrees, relative to a horizontal plane of an underside of the toroidal seat cushion; and such that the left straight surface lines are configured with a left downward inclination angle in a range of 1 to 45 degrees, relative to the horizontal plane of the underside of the toroidal seat cushion.

7. The toroidal seat cushion of claim 1, wherein an inner core of the toroidal seat cushion is made of open cell flexible polyurethane foam with a density in a range from 20 to 60 $kg/m^3$.

8. The toroidal seat cushion of claim 1, further comprising a cushion cover, which covers the toroidal seat cushion.

9. The toroidal seat cushion of claim 8, wherein the cushion cover is removable.

10. A method of configuring a support contour of a cushion to promote a healthy and comfortable sitting position, comprising: configuring a cushion with a ring-torus shape and a central aperture, which penetrates entirely through a central part of the cushion;

defining leg support areas, which are configured as contoured cutouts to position, guide and support legs of a user; and making a cutout in a rear area of the cushion, whereby a user experiences reduced pressure on a coccyx and central buttocks of the user, when seated in the cushion;

wherein the leg support areas are each further configured with a shape as an inner segment of an elliptic cylinder, whereby surface lines following an elongated direction of the elliptic cylinder are straight surface lines.

11. The method of configuring a support contour of a cushion of claim 10, wherein the leg support areas are further configured such that the straight surface lines comprise right and left straight surface lines of respectively the right and left leg support areas;

such that the right straight surface lines are configured with a right outward angle in a range of 1 to 45 degrees, relative to a centerline of the cushion; and such that the left straight surface lines are configured with a left outward angle in a range of 1 to 45 degrees, relative to the centerline.

12. The method of configuring a support contour of a cushion of claim 10, wherein the leg support areas are further configured such that the straight surface lines comprise right and left straight surface lines of respectively the right and left leg support areas;

such that the right straight surface lines are configured with a right downward inclination angle in a range of 1 to 45 degrees, relative to a horizontal plane of an underside of the cushion; and such that the left straight surface lines are configured with a left downward inclination angle in a range of 1 to 45 degrees, relative to the horizontal plane.

13. The method of configuring a support contour of a cushion of claim 10, wherein the cushion is further configured with a cushion cover.

14. A toroidal seat cushion, which is ring-torus shaped, comprising:

a. a central aperture, which penetrates entirely through a central part of the toroidal seat cushion, wherein the central aperture is configured in the shape of an elongated ellipsoid, such that an elongated center axis of the central aperture is perpendicular to a front to rear centerline of the toroidal seat cushion;

b. a right leg support cutout, which is positioned on an upper front right part of the toroidal seat cushion, such that the right leg support cutout is configured to support, guide, and position a right leg of a user that is seated on the toroidal seat cushion;

c. a left leg support cutout, which is positioned on an upper front left part of the toroidal seat cushion, such that the left leg support cutout is configured with a shape, which is symmetrical with a shape of the right leg support cutout, with respect to a front to rear centerline of the toroidal seat cushion, such that the left leg support is configured to support, guide, and position a left leg of the user that is seated on the toroidal seat cushion; and d. a rear-cutout, whereby the user experiences reduced pressure on a coccyx and central buttocks of the user, when seated in the cushion;

wherein entire surfaces of the right and left leg support cutouts are each configured with a shape as an inner segment of an elliptic cylinder, whereby surface lines following an elongated direction of the elliptic cylinder are straight surface lines;

wherein the straight surface lines comprise right and left straight surface lines of respectively the right and left cutouts;

such that the right straight surface lines are configured with a right outward angle in a range of 1 to 45 degrees, relative to the centerline of the toroidal seat cushion; and such that the left straight surface lines are configured with a left outward angle in a range of 1 to 45 degrees, relative to the centerline of the toroidal seat cushion;

wherein the straight surface lines comprise right and left straight surface lines of respectively the right and left cutouts;

such that the right straight surface lines are configured with a right downward inclination angle in a range of 1 to 45 degrees, relative to a horizontal plane of an underside of the toroidal seat cushion; and such that the left straight surface lines are configured with a left downward inclination angle in a range of 1 to 45 degrees, relative to the horizontal plane of the underside of the toroidal seat cushion;

whereby the toroidal seat cushion is configured to stabilize a seating position of the user, thereby providing relief from pressure and pain to a lower back and central buttocks of the user.

15. The toroidal seat cushion of claim 14, wherein an outer periphery of the toroidal seat cushion is oval-shaped.

16. The toroidal seat cushion of claim 1, wherein an outer periphery of the toroidal seat cushion is oval-shaped.

* * * * *